US009962013B2

(12) United States Patent
Kang

(10) Patent No.: US 9,962,013 B2
(45) Date of Patent: May 8, 2018

(54) FUNCTIONAL MAT FOR ASSISTING DEEP SLEEP OF INFANT

(71) Applicant: JUNE.F CO., LTD, Seoul (KR)

(72) Inventor: Duckjoong Kang, Yongin (KR)

(73) Assignee: JUNE.F CO., LTD, Seoul (KR)

( * ) Notice: Subject to any disclaimer, the term of this patent is extended or adjusted under 35 U.S.C. 154(b) by 0 days. days.

(21) Appl. No.: 15/320,293

(22) PCT Filed: Dec. 2, 2015

(86) PCT No.: PCT/KR2015/013060
§ 371 (c)(1),
(2) Date: Dec. 19, 2016

(87) PCT Pub. No.: WO2016/104980
PCT Pub. Date: Jun. 30, 2016

(65) Prior Publication Data

US 2017/0280893 A1 Oct. 5, 2017

(30) Foreign Application Priority Data

Dec. 26, 2014 (KR) ..... 10-2014-0190232
Nov. 9, 2015 (KR) ..... 10-2015-0156377

(51) Int. Cl.
*A47D 15/00* (2006.01)
*A47C 27/00* (2006.01)
*A47C 20/02* (2006.01)

(52) U.S. Cl.
CPC ..... *A47D 15/001* (2013.01); *A47C 20/02* (2013.01); *A47C 27/00* (2013.01); *A47D 15/005* (2013.01)

(58) Field of Classification Search
CPC . A47D 5/00; A47D 5/006; A47D 7/00; A47D 7/01; A47D 9/00; A47D 9/005; A47D 13/00; A47D 13/08; A47D 13/083; A47D 15/00; A47D 15/001; A47D 15/003;
(Continued)

(56) References Cited

U.S. PATENT DOCUMENTS 132,686 A * 10/1872 Pack et al. ..... A47C 27/001 5/722
3,626,526 A * 12/1971 Viel ..... A47C 27/16 5/421

(Continued)

FOREIGN PATENT DOCUMENTS

JP H09-234140 A 9/1997
JP 3089922 U 11/2002

(Continued)

*Primary Examiner* — Robert G Santos

(57) ABSTRACT

The prevent invention relates to a functional mat (1) for assisting deep sleep of an infant. The functional mat (1) for assisting deep sleep of an infant, according to the present invention, comprises: a mat body (10) for supporting an object (100), which is the body of an infant, in the upward direction; a side supporter (30) protruding from the surface of the mat body (10) in the perpendicular direction so as to form an overall shape of a hill, thereby supporting the object (100) in the lateral direction; and a pressurizing supporter (50), which is positioned to intersect or cross in the width direction of the mat body (10), and which is fixed to the mat (1) and is forced against the object (100).

13 Claims, 11 Drawing Sheets

(58) Field of Classification Search
CPC .... A47D 15/005; A47D 15/008; A47C 27/00; A47C 27/001
USPC ..... 5/655, 652, 657, 722, 723, 690, 691
See application file for complete search history.

(56) References Cited

U.S. PATENT DOCUMENTS 3,787,909 A * 1/1974 Johnson ..... A47C 3/16 297/118
5,193,238 A * 3/1993 Clute ..... A47D 13/08 5/490
5,216,772 A * 6/1993 Clute ..... A47D 13/08 5/630
5,331,699 A * 7/1994 Patton ..... A47D 13/08 128/876
5,347,669 A * 9/1994 Neviaser ..... A47D 15/008 5/630
5,450,640 A * 9/1995 Patton ..... A47D 13/08 5/421
5,551,109 A * 9/1996 Tingley ..... A47D 13/02 128/870
D378,615 S * 3/1997 Neviaser ..... D24/190
6,473,923 B1 * 11/2002 Straub ..... A47D 13/08 5/425
7,213,281 B2 5/2007 Hahn et al.
7,895,690 B2 * 3/2011 Kovalyak ..... A47D 13/08 5/655
8,863,337 B2 * 10/2014 Haye ..... A47D 15/00 5/655
2005/0204471 A1 9/2005 Ruiz
2005/0283915 A1 * 12/2005 Hahn ..... A47D 9/00 5/655
2009/0217458 A1 * 9/2009 Lord ..... A47D 13/08 5/655
2010/0192304 A1 * 8/2010 Kovalyak ..... A47D 15/008 5/655
2010/0319133 A1 * 12/2010 Whitlock ..... A47D 13/08 5/655
2013/0340174 A1 12/2013 Haye et al.
2017/0280893 A1 * 10/2017 Kang ..... A47C 20/02

FOREIGN PATENT DOCUMENTS

JP 2012-525238 A 10/2012
KR 10-2013-0025065 A 3/2013
KR 10-2014-0071204 A 6/2014
KR 20-2015-0000736 U 2/2015

* cited by examiner

FUNCTIONAL MAT FOR ASSISTING DEEP SLEEP OF INFANT

CROSS-REFERENCE TO RELATED APPLICATIONS

This application is a National Phase Application of PCT International Application No. PCT/KR2015/013060, which was filed on Dec. 2, 2015, and which claims priority from Korean Patent Application No. 10-2014-0190232 filed with the Korean Intellectual Property Office on Dec. 26, 2014, and Korean Patent Application No. 10-2015-0156377 filed with the Korean Intellectual Property Office on Nov. 9, 2015. The disclosures of the above patent applications are incorporated herein by reference in their entirety.

DESCRIPTION OF THE INVENTION

Technical Field

The present invention relates to a childcare accessory, more particularly to a functional mat that allows an infant to lie and sleep comfortably.

Background Art

Most parents want their children to sleep safely and comfortably. To satisfy such parents' demands, various mats designed for infants have been introduced. These mats would use cushion materials for comfort and would use blocks that keep children within a designated area for safety.

Korean Patent No. 930289 proposes a bedding for a baby or an infant. Various detachable and reattachable cushions protect the infant from accidents, and mobiles or mosquito nets can be added for greater functionality. Japanese Patent Publication No. 2005-124639 describes a mat that has an inclined structure, with the head part higher than the leg part, placing emphasis on allowing the infant to burp more easily after feeding. Korean Patent Publication No. 2006-25251 describes a mat designed for infants, where the mat made of a polyurethane material is provided with receptacles that can hold functional material such as silver powder, clay powder, charcoal powder, etc., to alleviate dermatitis or provide sterilization, or can receive a mobile coupled thereto.

Such prior art inventions carry the advantages of providing the comfort of a mat while ensuring the child's safety. When the child is simply laid down or is sleeping soundly, there is generally no particular reason for concern for an infant mat, in spite of the differences in functionality. Moreover, a parent would not be particularly bothered by such a situation.

However, one difficulty that the parent faces in terms of childcare is that children do not easily fall asleep. Even after the caretaker holds and calms a child and the child begins to fall asleep, in a majority of cases, the child would soon awake and cry when the child is laid down on the mat. This has led to the coining of the term "an infant's back sensor." Such back sensor problem may be found in most children under the age of 100 days. The term back sensor has been coined in reference to the observation that when a child's back touches a surface, the child immediately recognizes this and starts whimpering. Many parents are considerably vexed by this infant back sensor. Parents would again be compelled to hold and calm the child, and as this situation occurs repeatedly, the parents would become tired, and the child also would not be able to sleep comfortably. Under this circumstance, the benefits of the prior art inventions may not prove very helpful.

The inventors of the present invention have long studied ways to develop an optimized tool that can solve the back sensor problem, which plagues parents and bothers children, and allow an infant to sleep or rest comfortably and safely. The present invention was devised as a result of such research efforts.

SUMMARY OF THE INVENTION

Problem to be Solved

An objective of the invention is to provide a new childcare accessory that can help a child enjoy deep slumber in a comfortable manner. In particular, the invention focuses on effectively resolving the back sensor problem when a child begins to fall asleep.

In many cases, a parent or caretaker would lay a child, who has started falling asleep, down on a bed and then gently press the child's chest using both hands. The parent or caretaker would wait a while in this state. This is to artificially provide a sense of 'comfortable pressure.' However, if this state is removed, children might wake up again. An objective of the present invention is to provide a mat for an infant that is equipped with a means that serves as a substitute for such 'comfortable pressure.'

Another objective of the present invention is to safely protect a child lying on the mat while providing 'comfortable pressure.' A mat is proposed that is structurally configured to prevent an infant from rolling over in sleep and dying from asphyxiation.

Also, another objective of the present invention is to provide an infant mat structure that is suited to a child's body structure and is easy to use.

Objectives other than those specified above will be considered that can be derived from the detailed descriptions below and their resultant effects.

Technical Solution

To achieve the objectives above, an aspect of the present invention provides a functional mat for assisting deep sleep for an infant, where the functional mat includes:

a mat body that supports an object in an upward direction, the object being an infant's body;

a side supporter that protrudes in a perpendicular direction from a surface of the mat body in a generally hill-like shape and is configured to support the object in a sideward direction; and a pressure supporter that is positioned intersecting or crossing across the mat body along a widthwise direction and is secured to the mat and placed in close contact with the object.

In a functional mat for assisting deep sleep for an infant according to an embodiment of the present invention, the side supporter may be installed such that it is detachable with respect to the mat.

Also, in a functional mat for assisting deep sleep for an infant according to an embodiment of the present invention, the pressure supporter may be installed such that it is detachable with respect to the mat.

Also, in a functional mat for assisting deep sleep for an infant according to an embodiment of the present invention, a cushion filling part may be installed at a portion of the pressure supporter facing the object.

Also, in a functional mat for assisting deep sleep for an infant according to an embodiment of the present invention, a securing means for securing the pressure supporter may be installed at a mat edge position or a lower surface position of the side supporter.

Also, in a functional mat for assisting deep sleep for an infant according to an embodiment of the present invention, one or more fastening hole may be installed in the side supporter.

Furthermore, in a functional mat for assisting deep sleep for an infant according to an embodiment of the present invention, the fastening hole can be a hole that penetrates through a mat edge side and a lower surface of the side supporter, and a fastener installed on the mat body can be inserted into the fastening hole to fasten the mat body and the side supporter.

Also, in a functional mat for assisting deep sleep for an infant according to an embodiment of the present invention, a connector piece on one side of the pressure supporter can be coupled with the fastener to secure the one side of the pressure supporter.

In a functional mat for assisting deep sleep for an infant according to another embodiment of the present invention, the fastening hole can be a hole that penetrates through a mat edge side and an opposite side of the side supporter, and a connector piece on one side of the pressure supporter can be inserted into the fastening hole and connected to the mat body to secure the one side of the pressure supporter.

In a functional mat for assisting deep sleep for an infant according to an embodiment of the present invention, one side of the pressure supporter can be positioned over the object and the other side can be positioned under the object, with respect to the object, during use of the pressure supporter.

Also, in a functional mat for assisting deep sleep for an infant according to another embodiment of the present invention, the pressure supporter can include a pair of wings, and the pair of wings can be fastened to each other over the object to be placed in close contact with the object during use of the pressure supporter.

Also, in a functional mat for assisting deep sleep for an infant according to an embodiment of the present invention, the side supporter can be installed on the mat body, corresponding to any one of the following:

a side supporter installed at one side of the mat body;

side supporters installed at both sides of the mat body;

a side supporter installed near a center of the mat body; and side supporters installed at an upper side, a lower side, a left side, and a right side of the mat body.

Also, in a functional mat for assisting deep sleep for an infant according to an embodiment of the present invention, the edge at an opposite end of the mat body from the position where the side supporter is installed may have a greater height than that of a surface at a center portion of the mat body.

A second aspect of the present invention provides a functional mat for assisting deep sleep for an infant, where the functional mat includes:

a mat body that supports an object in an upward direction, the object being an infant's body; and a pressure supporter that is connected to both ends of the mat body along a lengthwise direction of the mat body and is formed with a pair of wings, each of the wings configured to fasten to or unfasten from an opposite wing at a position over the mat body.

Also, a functional mat for assisting deep sleep for an infant according to an embodiment of the present invention can further include a side supporter that protrudes in a perpendicular direction from a surface of the mat body in a generally hill-like shape, where the side supporter can support the object in a sideward direction. Also, the pressure supporter can be configured to be detachably connected with or separated from the mat body.

Effects of the Invention

An embodiment of the present invention not only allows an infant to lie down comfortably on a mat but also provides 'comfortable pressure' as the child sleeps, so that the infant can feel as if a parent is gently pressing the infant's chest. In this way, the back sensor problem can be effectively resolved, and a comfortable environment can be provided in which the infant may sleep soundly.

Moreover, a functional mat for assisting deep sleep for an infant based on an embodiment of the present invention can provide both safety and comfort when inducing a young child to sleep, thereby reducing the parent's burden in terms of the effort and time used in putting the child to sleep.

Also, if a height measurement marking part is installed on a surface of the functional mat, with which to measure the infant's height, there is the additional advantage of being able to check the infant's growth daily in a convenient manner.

It is to be appreciated that any effect disclosed in the specification and any tentative effect anticipated from the technical features of the present invention, although not explicitly mentioned as an advantageous effect, should be regarded in the same light as the advantageous effects disclosed herein.

BRIEF DESCRIPTION OF THE DRAWINGS

FIG. 1 schematically illustrates the relationships of the object 100 with the mat body 10 and the side supporters 30 in a functional mat 1 for assisting deep sleep for an infant according to certain embodiments of the present invention.

FIG. 2 illustrates examples of the positions and numbers of side supporters 30 in various embodiments of the present invention.

FIG. 3 is a magnified view illustrating an example of how a side supporter 30 and a mat body 10 may be connected according to an embodiment of the present invention.

FIG. 4 illustrates an example of how the components may be connected in a functional mat 1 for assisting deep sleep for an infant according to an embodiment of the present invention.

FIG. 5 illustrates an example of how a pressure supporter 50 may be connected to the functional mat 1 according to another embodiment of the present invention.

FIG. 6 illustrates an example of how a pressure supporter 50 may be connected to the functional mat 1 according to yet another embodiment of the present invention.

FIG. 7 illustrates an example of how a pressure supporter 50 may be connected at a lower surface of a side supporter 30 according to yet another embodiment of the present invention.

FIG. 8 illustrates an example of a schematic front view of a functional mat 1 according to an embodiment of the present invention.

FIG. 9 illustrates an example of a schematic rear view of a functional mat 1 according to an embodiment of the present invention.

FIG. 10 illustrates examples of cross-sections of components of a functional mat 1 based on an embodiment of the present invention.

FIG. 11 illustrates how a functional mat 1 according to an embodiment of the present invention may be used.

FIG. 12 illustrates an example of a composition on a surface of a functional mat 1 according to another embodiment of the present invention.

It is to be appreciated that the accompanying drawings are provided only as examples to aid the understanding of the technical spirit of the present invention; the scope of the present invention is not to be limited by the drawings.

DETAILED DESCRIPTION OF THE INVENTION

In describing the present invention, certain known functions that are relevant to the invention but are apparent to a person skilled in the art will not be described in great detail, if it is deemed that this may unnecessarily obscure the essence of the present invention.

Figure 1:
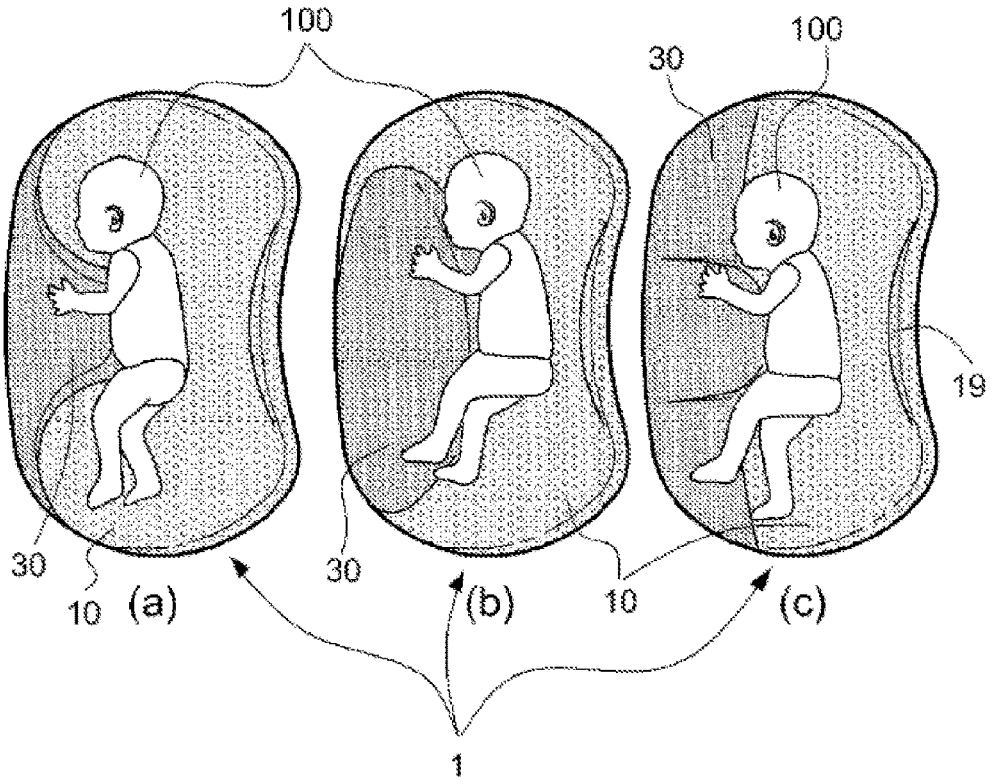
FIG. 1 through FIG. 7 are drawings relating to a first aspect of the present invention.

The functional mat 1 for assisting deep sleep for an infant based on an embodiment of the present invention may include a mat body 10, a side supporter 30, and a pressure supporter 50. FIG. 1 conceptually illustrates the functions of the mat body 10 and the side supporter 30. In particular, various forms of the side supporter 30 are illustrated. Although the drawing does not show variations of the mat body 10, the physical dimensions of the mat body 10 can also be modified. In implementing the spirit of the present invention, the sizes and forms of the mat body 10, side supporter 30, and pressure supporter 50 do not limit the scope of the present invention.

The mat body 10 may serve as a mat of a cushioned material on which an infant's body 100 (hereinafter referred to as 'object') may be laid. Therefore, the mat body 10 may support the object 100 in an upward direction.

Since the mat body 10 supports the infant's body, it may be made of a cushion material. Various types of cushion material can be used. The cushion material can be selected to include one or more of latex, memory foam, polyurethane, air cushion, cotton filler, and substitutes thereof. Also, the mat body 10 may be composed with such a cushion material as an inner lining and natural cotton as an outer lining that receives the cushion material. The outer lining may desirably be composed such that its surface allows sufficient air permeability. This can improve the feel on the skin and allow convenient washing. Such properties of the cushion material can also apply to the side supporter 30 described below. Of course, the pressure supporter can also be partially or entirely made of a cushion material as above.

When sleeping, people usually lie facing sideways. This is also true for infants. The side supporter 30 may support the object 100 in a sideward direction of the object 100. The sideward direction' may be understood more in regard to the side of the object 100, rather than the side of the mat body 10. To support the object 100 in a sideward direction, the side supporter 30 may form a sidewall with respect to the surface of the mat body 10. That is, the side supporter 30 may be characterized as a structure that protrudes in a perpendicular direction from the surface of the mat body 10 in a generally gently sloping hill-like shape.

FIG. 1(*a*) shows an example in which the side supporter 30 is installed at one side with respect to a lengthwise direction of the mat body 10. With the embodiment of FIG. 1(*a*), a plan view (looking at the drawing from the front) shows a structure in which a center portion of the side supporter 30 protrudes towards the middle of the mat body 10 on which the object 100 is laid. Because of this structure, the side supporter 30 is given a convex portion and concave portions. The concave portions provide room for accommodating movement by the body parts of the object 100. The convex portion may press the object 100 on the chest from the side, to provide 'comfortable pressure' as sought by the present invention.

FIG. 1(*b*) shows an example in which the side supporter 30 is structured to curve in an arc-like shape towards the object 100 in a plan view. By thus restricting movement by the body parts of the object 100, an environment similar to that attained when a parent holds a sleeping child can be provided. Of course, in this case also, the gently curved shape can protrude the furthest at the portion corresponding to the chest area, so as to provide 'comfortable pressure'.

FIG. 1(*c*) shows a variation that combines the advantages of the structure shown in FIG. 1(*a*) and the structure shown in FIG. 1(*b*). The movement by the face and legs of the object 100 is more restricted, but the pressure on the chest area of the object 100 is similarly more emphasized.

The edge 19 at the end of the mat body opposite the position of such side supporter 30 can be made to be higher than the surface of the center portion of the mat body. This is to restrict the object 100 from rolling in the opposite direction.

From FIG. 1, it can be seen that the side supporter 30 protruding above the surface of the mat body 10 in a hill-like shape can be implemented in a variety of forms. However, the installation position of the side supporter 30 need not be limited to one side of the mat body 10 as illustrated in FIG. 1. This is clearly illustrated in FIG. 2.

Figure 2:
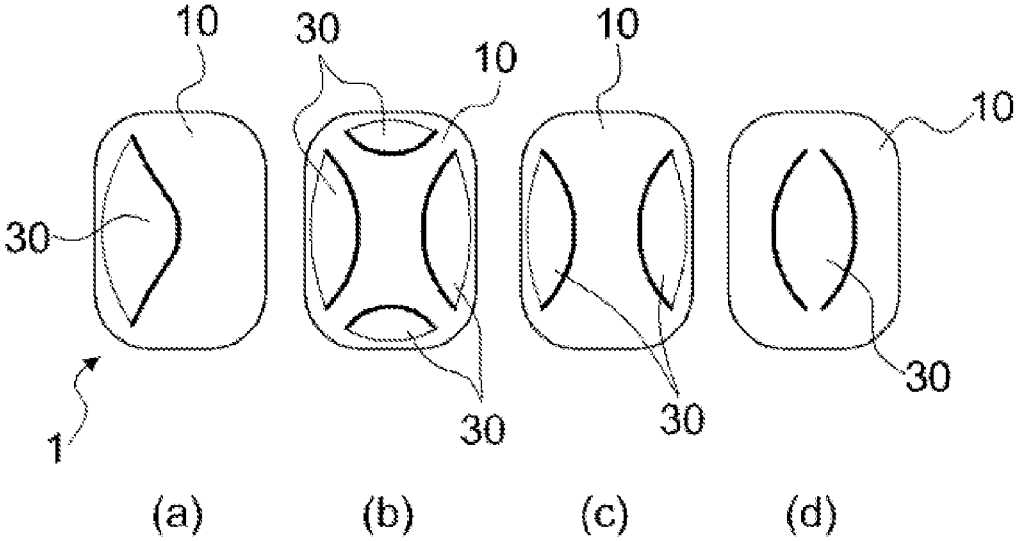

FIG. 2(*a*) can be regarded as an example corresponding to FIG. 1. The side supporter 30 is installed at a side of the mat body 10. While just one may be installed as illustrated in the drawing, it is also possible to install a multiple number of side supporters 30.

In FIG. 2(*b*), there are side supporters 30 installed on the upper, lower, left, and right sides of the mat body 10. This may restrict the object lying on the mat body 10 from moving upwards or downwards. While this can provide the advantage of ensured stability, the area of the mat can be decreased as a result. Of course, this would not be a problem if the dimensions of the mat itself are increased. Sufficient large dimensions for the mat can also provide the advantage of accommodating two or more objects.

FIG. 2(*c*) illustrates a composition in which the side supporters 30 are installed on both sides of the mat body 10. FIG. 2(*d*) illustrates a composition in which the side supporter 30 is installed near the center of the mat body 10. Thus, due to the presence of the side supporter 30, a functional mat based on an embodiment of the present invention may include, not a flat composition like a bed, but a hill region gently protruding towards an upper space with respect to the surface, with this hill region restricting sideways movement of the object 100. The reason for restricting the sideways movement is to structurally ensure that comfortable pressure is provided in relation with the pressure supporter described below.

A description is now provided on the various positions and forms in which the side supporter 30 may be installed. For sure, the side supporter 30 may be installed on the mat body 10, but in a certain embodiment can also be installed in an integrated form. As first embodiment of an integrated installation can involve the mat body 10 and the side supporter 30 manufactured in an integrated form (for example, molded and cast as an integrated body and covered with an outer lining). A second embodiment of an integrated installation can involve manufacturing the mat body 10 and the side supporter 30 separately but provided to the consumer after the side supporter 30 is attached to the mat body 10. For example, the side supporter 30 can be secured onto a surface of the mat body 10 with a fastening means such as velcro, etc., after which the two can be processed simultaneously with an outer lining to complete the mat according to an embodiment of the present invention.

In another embodiment of the present invention, the side supporter 30 can be detachably coupled. In other words, the user can connect or disengage the side supporter 30 to or from the mat body 10 as necessary.

Figure 3:
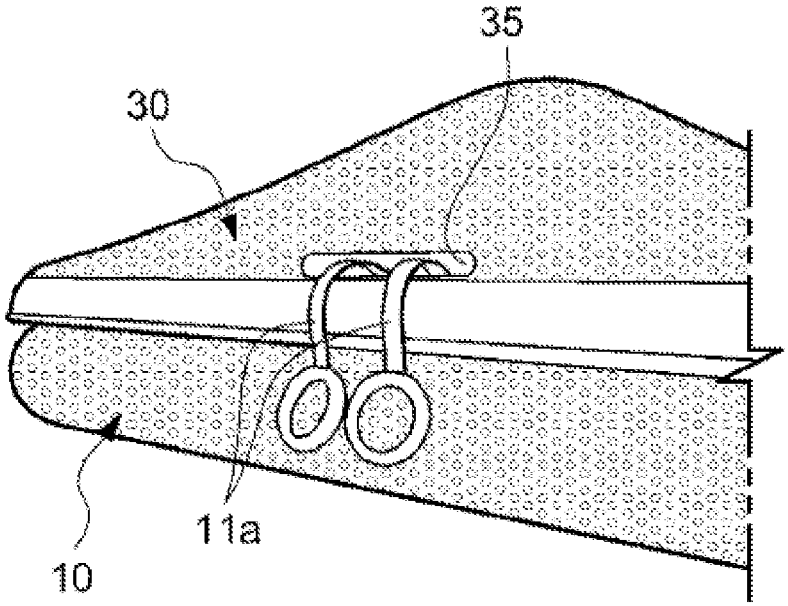

The details of the detachable coupling can be devised in various ways. One embodiment is illustrated in FIG. 3. A fastening hole 35 can be provided which penetrates through a mat edge side and a lower surface of the side supporter 30, and a fastener 11*a* that is installed on the mat body 10 can be inserted through this fastening hole 35, whereby the side supporter 30 can be fastened to the mat body 10. The fastener 11*a* can include a pair of rings and a string attached to each ring, as in the illustration. As will be described again later on, the fastening hole 35 and fastener 11*a* can also be used to fasten the pressure supporter as well.

Figure 4:
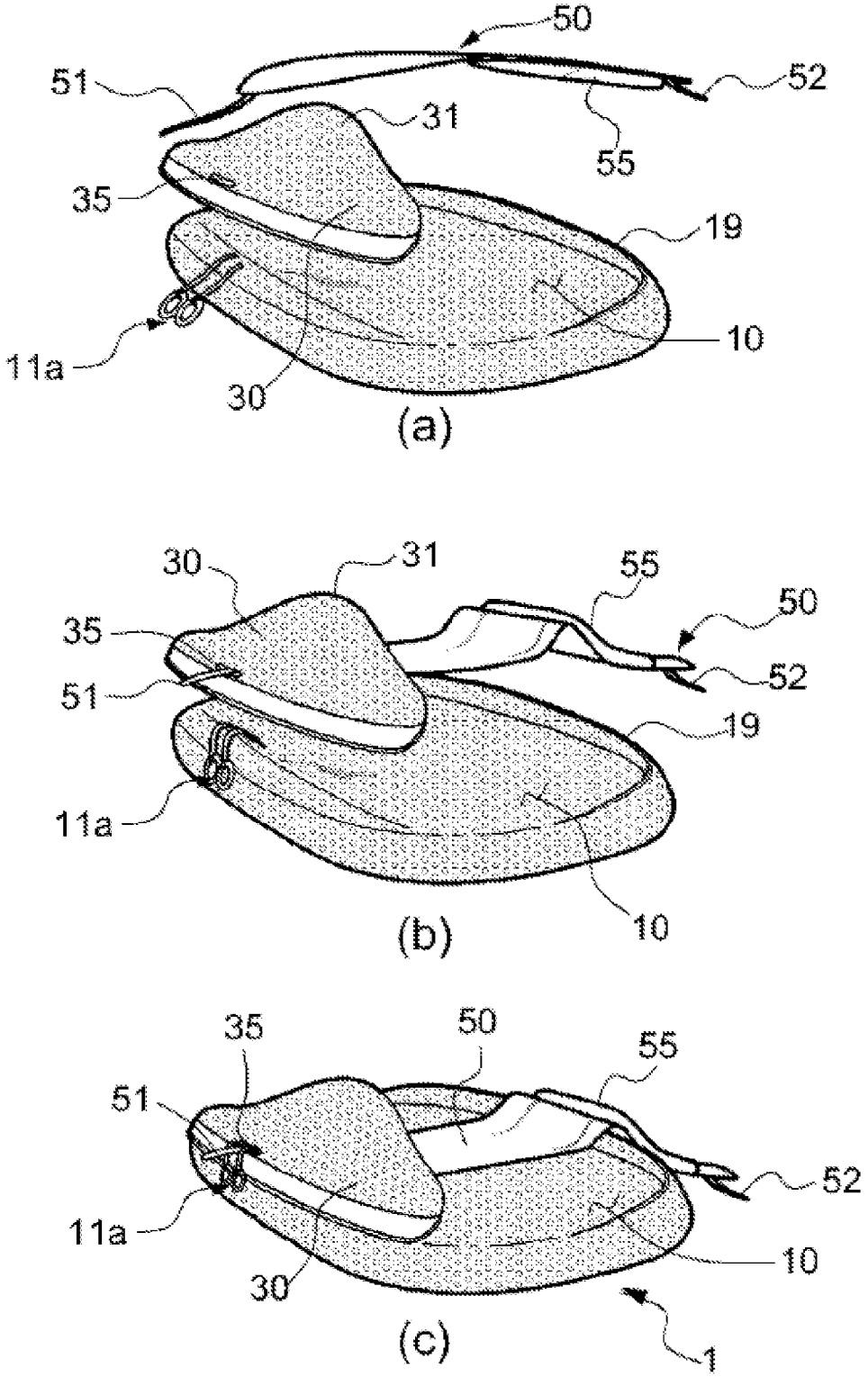

Although it is not shown in the drawings, the detachable coupling of the side supporter 30 and the mat body 10 can employ various means, such as velcro fasteners, male and female buttons, zippers, strings, etc. Structurally, the fastening hole 35 can be used in conjunction with fastening means such as the velcro, zipper, string, button, buckle, etc., for connecting the side supporter 30 with the mat body 10. The spirit and scope of the present invention are not limited by variations of the detachable coupling FIG. 4 illustrates the basic composition of a mat 1 according to a certain embodiment of the present invention. The manner in which the mat body 10, side supporter 30, and pressure supporter 50 are coupled is illustrated. When the side supporter 30 is installed onto the mat body 10 as illustrated in the drawing, a side wall may be formed with respect to the hilled summit portion 31 of the side supporter 30. Then, by installing the pressure supporter 50, an environment for providing comfortable pressure to the object (not shown) may be achieved.

As illustrated in FIG. 4(*a*), the side supporter 30 may be positioned at a side surface of the mat body 10. The fastening hole 35 of the side supporter 30 described with reference to FIG. 3 can be formed as a hole that penetrates through a position corresponding to the edge of the mat body, a position on the opposite side, and a position on the lower surface. As illustrated in FIG. 4(*b*), a connector piece 51 on one end of the pressure supporter 50 may be inserted into this fastening hole 35. Also, as shown in FIG. 4(*c*), the fastener 11*a* of the mat body 10 may also be inserted into the fastening hole 35.

Next, by connecting the fastener 11*a* of the mat body 10 with the connector piece 51 of the pressure supporter 50, the main components of the present invention can be coupled together. Preferably, a velcro fastener can be installed on one side of the connector piece 51, in which case the connector piece 51 can be inserted through a ring of the fastener 11*a*, and the connector piece 51 can be formed into a loop for fastening. It would also be possible to have the connector piece 51 inserted through the ring of the fastener 11*a* and formed into a knot.

FIG. 4 shows an example of how the pressure supporter 50 may be implemented. In the arrangement shown in FIG. 4(*c*), when the object is laid down, the opposite end of the pressure supporter 50 may be moved in the direction of the side supporter 30. Afterwards, the connector piece 52 on the opposite side may be connected with the ring of the fastener 11*a* on the mat body 10. Then, the object laid on the mat body 10 may naturally turn towards the side supporter 30, resulting in a posture shown in FIG. 1. When the connector piece 52 of the pressure supporter 50 is pulled adequately, the side supporter 30 can provide comfortable pressure from the object's side (chest area), while the pressure supporter 50 can provide comfortable pressure towards the object from the top. Also, the side supporter 30 and the pressure supporter 50 structurally prevent the infant from flipping over during sleep. Therefore, use of the present invention may prevent occurrences in which an infant suffers asphyxiation during slumber.

Preferably, a cushion filling part 55 may be installed on the pressure supporter 50. The cushion filling part 55 may desirably be installed at a position facing the object; more preferably, the cushion filler may desirably be positioned inside the outer lining of the pressure supporter 50 in such a way that its position can be adjusted. That is, a holding space may additionally be installed that is longer than the cushion filler along the lengthwise direction of the pressure supporter 50.

The pressure supporter 50 installed to be detachably coupled with the mat 1 may have one side positioned below the object and the other side positioned over the object, as shown in the embodiment of FIG. 4. This is also true for the embodiment shown in FIG. 5. However, the embodiment of FIG. 5 proposes a variation on the method of fastening the pressure supporter 50 onto the mat 1.

Figure 5:
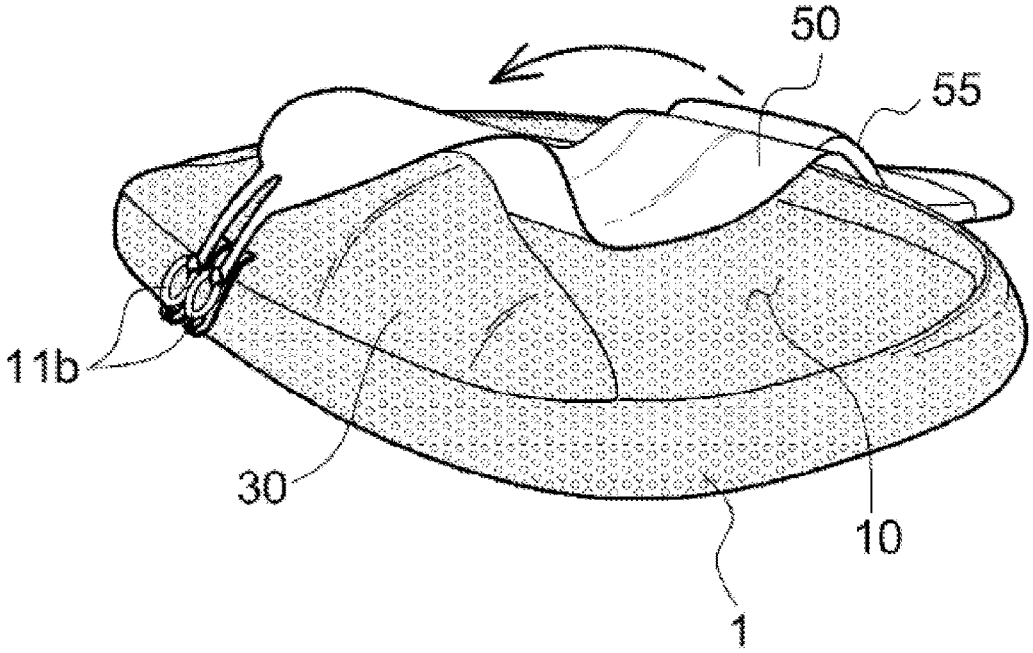

The embodiment shown in FIG. 5 differs from the embodiment of FIG. 4 in that the functional mat has the mat body 10 and the side supporter 30 implemented as an integrated body. In this case also, a fastener 11*b* may be installed at an edge portion of the side supporter 30, and a connector piece 51 on one side of the pressure supporter 50 may be secured to this fastener 11*b*. Then, the connector piece 52 on the other side of the pressure supporter 50 may be moved in the direction of the arrow to be connected and secured to the fastener 11*b*. The method of connecting the pressure supporter 50 to the mat 1 for securing may be the same as that described for FIG. 4. Also, there can be numerous variations. The mechanism for providing the object with comfortable pressure may also be no different.

Figure 6:
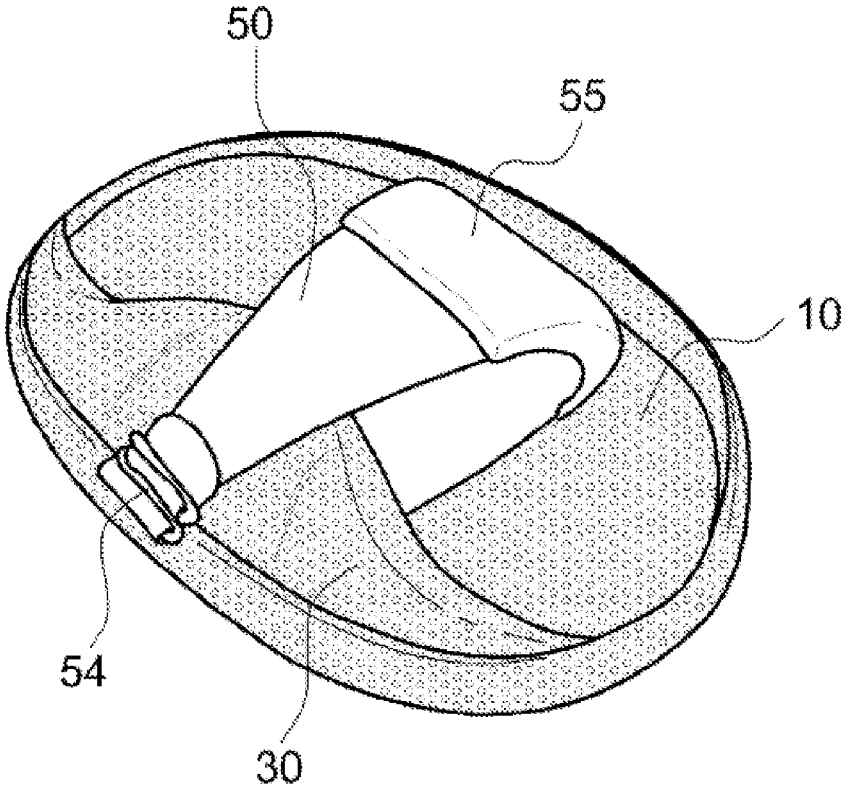

FIG. 6 proposes another embodiment having the pressure supporter 50 connected to the mat 1.

As with the embodiment of FIG. 5, the mat body 10 and the side supporter 30 can be secured as an integrated body. Of course, it would also be possible to achieve the securing with a zipper running along the edge of the mat body 10. In any case, one side of the pressure supporter 50 may be secured through a lower surface of the side supporter 30, with its end portion formed as a buckle 54 that is exposed outside roughly near a center portion of the side supporter 30. After one end of the pressure supporter 50 is secured by way of the above composition, the object may be positioned over the pressure supporter 50, and the other side may be moved towards the side fabric 50 and fastened using the buckle 54. Here, the object may be placed in close contact with the side supporter 30. Also, the cushion filling part 55 may contact the object.

Figure 7:
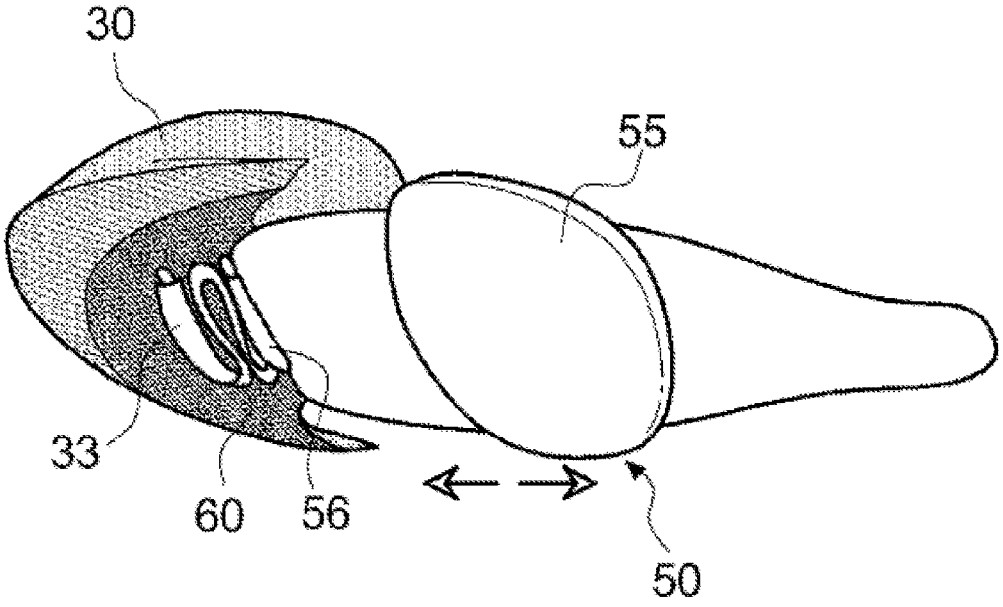

FIG. 7 proposes another embodiment having the pressure supporter 50 installed on the mat 1. This embodiment emphasizes an alternative method of securing the one end of the pressure supporter 50. As illustrated in FIG. 7, a securing ring 56 may be installed at one end of the pressure supporter 50, and a fitter element 60 having elasticity may be fitted into this securing ring 56. As the connection between the securing ring 56 and the fitter element 60 occurs at the lower surface of the side supporter 30, it may not be exposed to the exterior. The opposite side of the fitter element 60 may be inserted through and connected to a securing ring 33 installed at a lower surface of the side supporter 30. With this composition implemented, the side supporter 30 can be installed on the mat body 10 using the method described above or a variation thereof to complete the functional mat based on an embodiment of the present invention. Similarly, the filler for the cushion filling part 55 can be implemented such that its position is adjustable within the outer lining of the pressure supporter 50.

The embodiments above show that each of the various types of pressure supporters 50, when used for the object, has a portion that is positioned crossing over the surface of the mat body 10 along a widthwise direction of the mat body 10. That is, at least one element of the pressure supporter 50 is positioned crossing along the widthwise direction of the mat body 10 over the object, in close contact with the object.

Figure 8:
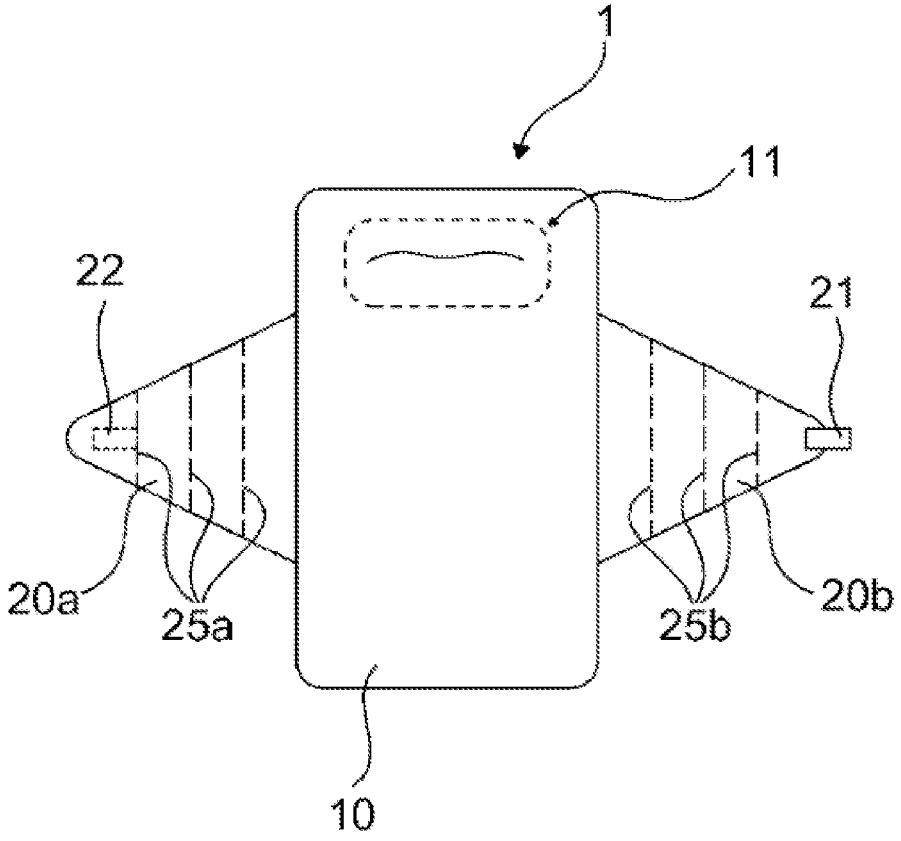
FIG. 8 through FIG. 12 are drawings relating to a second aspect of the present invention.

FIG. 8 schematically illustrates the front structure of a functional mat 1 for assisting deep sleep for an infant in another embodiment of the present invention. The functional mat 1 for assisting deep sleep for an infant may include a mat body 10 and a pair of wings 20*a*, 20*b*. In this embodiment, this pair of wings 20*a*, 20*b* may serve as a pressure supporter. In particular, this embodiment provides an example of the pressure supporter intersecting in a widthwise direction of the mat body 10 to be positioned over the surface of the mat body 10.

A child may lie over the surface of the mat body 10. Since the mat body 10 supports the infant's body, it may be made of a cushion material. This is no different from the embodiment of FIG. 1.

The infant's head may be positioned at the upper side of the mat body 10, while the legs may be positioned at the lower side. Curves may desirably be formed at the head region portion 11 of the mat body 10. Also, the thickness of the head region portion 11 may desirably be greater than the thickness of the leg region portion. This will be described again later on.

The pair of wings 20*a*, 20*b* may be connected to both sides of the mat body 10, respectively. As in the illustration, the wings 20*a*, 20*b* may desirably be implemented such that the width at the root of a wing is greater than the width at the sleeve of the wing. Such an arrangement prevents the infant from feeling constricted when the wings 20*a*, 20*b* are folded, and at the same time, continues to provide comfort even if a restless infant's body moves beyond the mat body 10.

The pair of wings 20*a*, 20*b* may also be desirably made of a cushioned material. In a certain embodiment of the present invention, the cushion material of the wings 20*a*, 20*b* can be of the same type as the cushion material of the mat body 10. In another embodiment of the present invention, the cushion material of the wings 20*a*, 20*b* can be of a different type from the cushion material of the mat body 10. In particular, one or more of latex, memory foam, polyurethane, cotton filler, and substitutes thereof can desirably be selected. Also, such a cushion material may be used as an inner lining, with natural cotton as an outer lining that receives the cushion material. This can improve the feel on the skin and allow convenient washing.

In an embodiment of the present invention, a pair of wings 20*a*, 20*b* may be folded in directions facing each other to be folded over the mat body 10, and in order that this operating mechanism may be performed more naturally, folding lines 25*a*, 25*b* can also be formed in the wings 20*a*, 20*b*, as in the illustration.

A fastening means 21, 22 can be installed left and right on the sleeve portion of each wing 20*a*, 20*b*. In the illustration, a fastening piece 21 is installed on one wing 20*b*, while a fastening part 22 that uses velcro coupling with the fastening piece 21 is installed on the other wing 20*a*, as an example of a fastening means. However, it is obvious that numerous variations are possible. For instance, the fastening means may include a knot or a button. By folding and securing a pair of wing parts in this manner, it is possible to provide comfortable pressure to the object.

Figure 9:
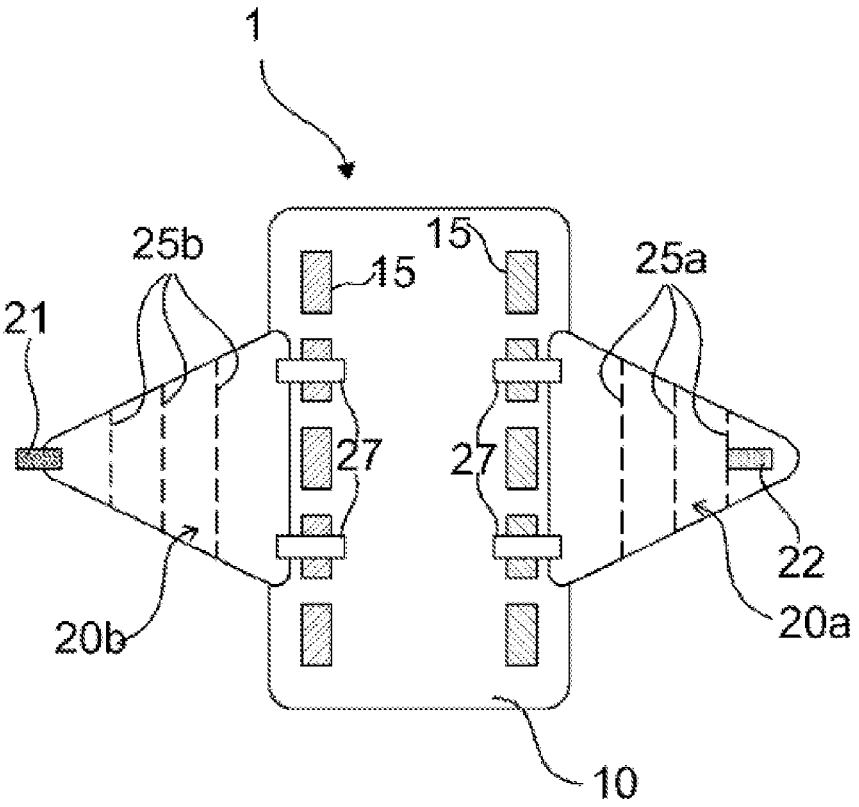

FIG. 9 shows an example of the rear composition of a functional mat 1 based on an embodiment of the present invention. In an embodiment of the present invention, a functional mat 1 is proposed in which the mat body and the pair of wings are separable, rather than being coupled as an integrated body. From FIG. 9, it can be seen not only that the pair of wings 20*a*, 20*b* can be detachably coupled with the mat body but also that the coupling position can be varied.

As shown in FIG. 9, on the rear surface 10*b* of the mat body, multiple numbers of wing coupler parts 17, 18 can be installed on the left and right sides along the lengthwise direction of the mat body. After selecting the wing coupler parts 17, 18, the coupler pieces 27, 28 installed at the root positions of the wings 20*a*, 20*b* can be coupled to or separated from the coupler parts 17, 18.

Since the positions for coupling the pair of wings 20*a*, 20*b* to the mat body 10 can be selected along the left and right lines as in the illustration, the positions of the wings 20*a*, 20*b* can be varied according to the infant's body.

Also, the method of coupling the wing coupler parts 17, 18 and the coupler pieces 27, 28 can be devised in various ways. Preferably, a velcro coupling can be used. For instance, the wing coupler parts 17, 18 installed along the left and right lines on the rear surface 10*b* of the mat body can have female velcro parts, while the coupler pieces 27, 28 installed on the root positions of the wings 20*a*, 20*b* can have male velcro parts. This arrangement would allow velcro coupling. Also, the wing coupler parts 17, 18 and the coupler pieces 27, 28 can be formed as male and female buttons to allow button-based detachable coupling. In another example, the wing coupler parts can be formed as rings, and the coupler pieces 27, 28 of the wings 20*a*, 20*b* can be placed into the rings and tied in knots.

Figure 10:
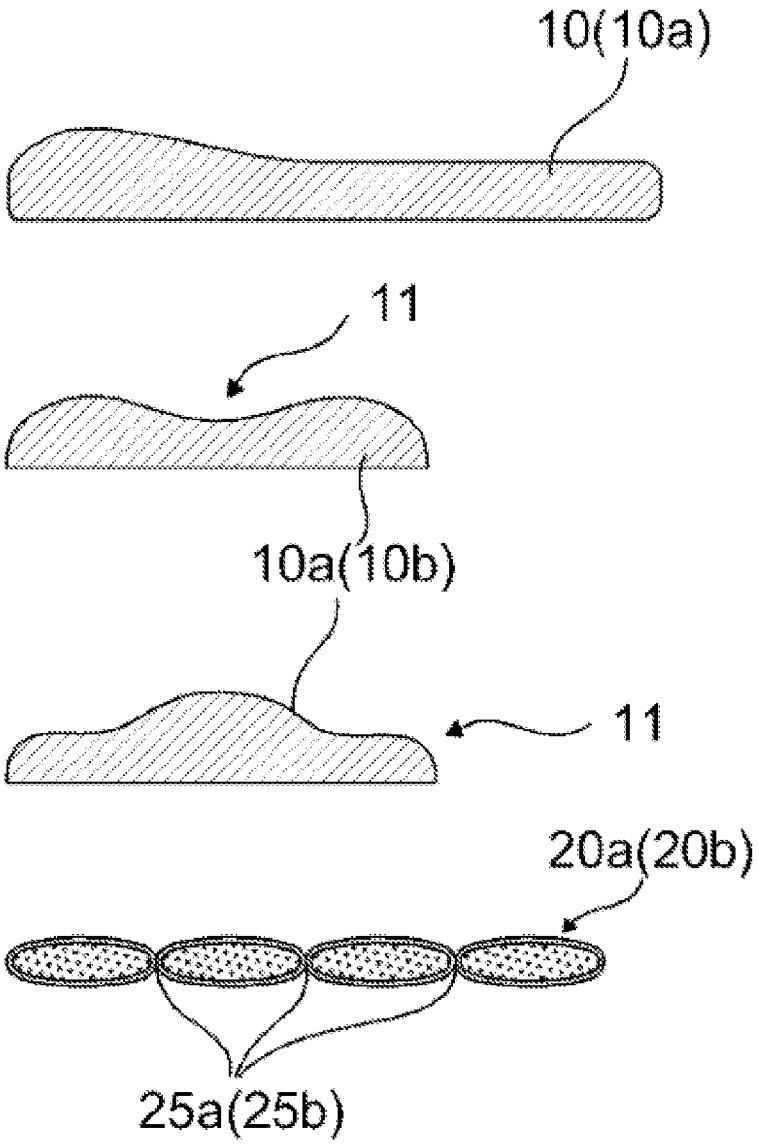

FIG. 10 shows examples of cross sections for each component of the functional mat 1 in the embodiment illustrated in FIG. 8.

FIG. 10(*a*) shows the cross section of the mat body 10 along the lengthwise direction. As illustrated in this drawing, the thickness of the mat body 10 can be made different overall. As described earlier, by having the head region portion 11 of the mat body 10 thicker than the leg region portion, it is possible to let the child feel more comfortable. With this arrangement, the head region portion 11 may serve as a headrest.

FIG. 10(*b*) shows a cross section across an upper portion, i.e. the head region portion 11, after rotating the mat body 10 of FIG. 10(*a*) by 90 degrees, in a certain embodiment of the present invention. As can be seen from the embodiment of FIG. 10(*b*), curves can be formed in the head region portion 11 in an embodiment of the present invention, where the curves may be formed with the thickness of the inner portion smaller than the thickness of the two end portions, thus forming a recess, so that the infant's head can be positioned ergonomically in the recess. Next, as the pair of wings 20*a*, 20*b* are connected facing each other, the wings 20*a*, 20*b* may enwrap the child's body and apply a particular amount of pressure. In this manner, an infant's back sensor problem could be considerably improved. This was analyzed to be because the resulting effect is similar to that of a parent laying down a child that has begun to fall asleep and gently pressing the child's chest with both hands.

FIG. 10(*c*) illustrates another embodiment of the present invention. Shown is a cross section across an upper portion, i.e. the head region portion 11, after rotating the mat body 10 of FIG. 10(*a*) by 90 degrees. Unlike FIG. 10(*b*), the curved portion in FIG. 10(*c*) does not have a convex portion instead of a recess formed in the middle. This arrangement can optimally respond to a child's habit of sleeping on his/her side. Also, while the child is lying on his/her side, the wings 20*a*, 20*b* may be connected facing each other, so that the wings 20*a*, 20*b* may enwrap the child's body and apply a particular amount of pressure. In this manner, the infant's so-called back sensor problem could be resolved most effectively.

FIG. 10(*d*) shows an example of the cross section of a pair of wings 20*a*, 20*b* based on an embodiment of the present invention. As shown in FIG. 10(*d*), the pair of wings 20*a*, 20*b* can be made of a cushion material, and can include folding lines 25*a*, 25*b*.

Figure 11:
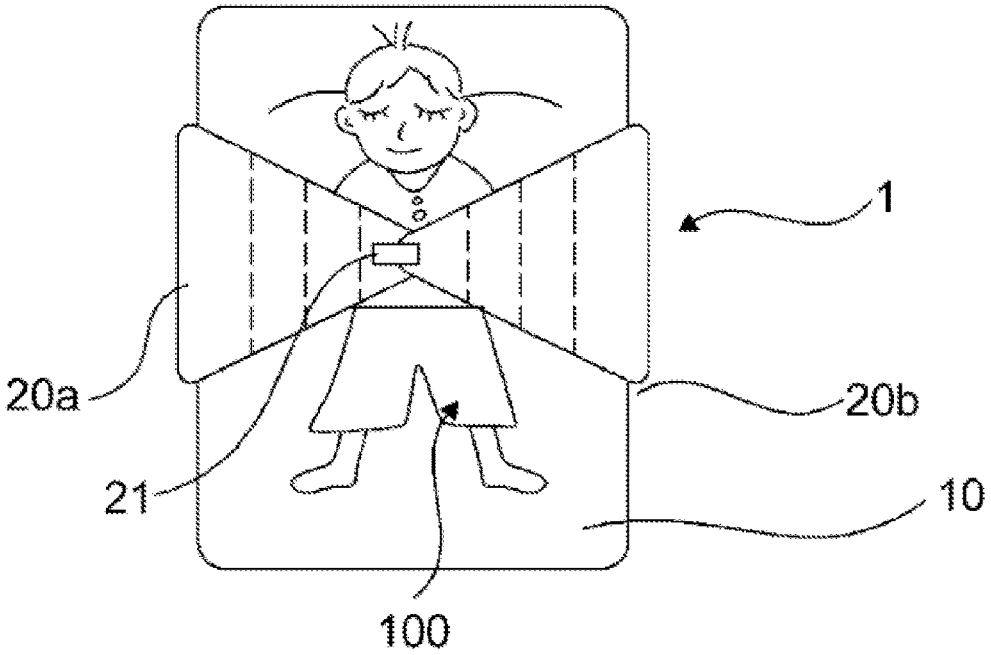

FIG. 11 illustrates an example of how a functional mat 1 based on an embodiment of the present invention may be used. While the child 100 is laid down, the pair of wings 20*a*, 20*b* can be folded, and the pair of wings 20*a*, 20*b* can be overlapped and fastened together using the fastening means 21 on each wing 20*a*, 20*b*, at a position above the mat body 10. Fastening the pair of wings in this manner can protect the child's body, and at the same time, the pair of wings 20*a*, 20*b* can be positioned at the child's chest area, so that the weight of the wings and the pressure created by the fastening may apply comfortable pressure on the child's chest.

This fastening mechanism of the pair of wings 20*a*, 20*b* may implement a function analogous to a parent gently pressing a laid child's chest with a hand to allow the child to sleep more soundly. An infant sleeping on a mat can experience a sensation similar to a parent pressing his/her chest and can thus sleep more comfortably. From tests performed after fabricating a model of a functional mat based on an embodiment of the present invention, the inventor of the present invention has found that the pair of wings coupled together facing each other provide pressure on a child's chest, and as a result, the child's habit of waking and crying when laid down was almost eliminated. On a function mat 1 based on an embodiment of the present invention, the child was able to sleep comfortably and safely. This would provide the added effect of enabling the parent to perform other tasks with an easy mind.

Figure 12:
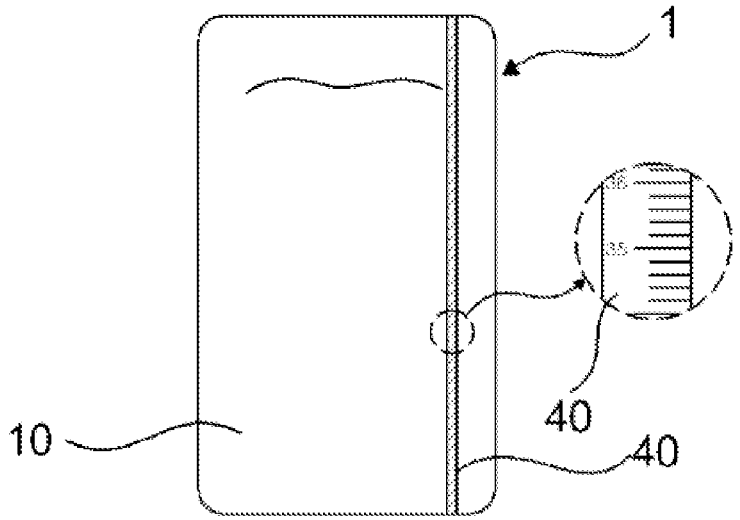

FIG. 12 shows another possible application of an embodiment of the present invention. On one side of the surface of a mat body 10 based on an embodiment of the present invention, a height measurement marking part 40 can be installed along a lengthwise direction of the mat body 10. The height measurement marking part 40 can have calibrated lines like those on a ruler. With a height measurement marking part installed as an integrated body on a surface of the mat body 10, it is possible to measure the height of a child after laying the child down on the mat body 10. Babies and infants grow at a fast pace, and information regarding a child's height may serve as a very important measure of health. As such, parents inevitably have great interest in their children's height information. An advantageous effect obtained is that, whenever a child is laid down and put to sleep on an arrangement such as the embodiment of the present invention shown in FIG. 5, the parents can intuitively see the child's growth information. In situations where the child is awake, the child's body can be straightened out for accurate measurement of height.

The height measurement marking part 40 can be installed by sewing an element having calibrated lines onto the surface of the mat body 10. Here, it would be preferable to use the same material as that of the outer lining of the mat body 10 so as not to degrade the child's tactile feel. Also, in another embodiment, the calibrated lines can be printed onto the outer lining of the mat body 10, so that the height measurement marking part 40 may be formed as an integrated body on the surface of the mat body 10.

<Variations>

1. The present invention relates to the structure of a functional mat 1 for assisting deep sleep for an infant, where the dimensions of the length, width, and thickness can be modified to optimal values for manufacture. However, the scope of the present invention is not limited by such values. In the appended drawings, the dimensions of the forms are exaggerated in their expression, and as such, the dimensions of the functional mat 1 based on an embodiment of the present invention are not limited by the proportions of the forms shown in the drawings. Preferably, materials that are good for a child's skin may be used for the materials of the functional mat 1.

2. Visual elements or visible alterations can be added to a functional mat 1 based on an embodiment of the present invention. For instance, colors or character features can be added.

3. Also, receptacle elements can be installed at predetermined positions in the surface of the mat body 10 or the wings 20*a*, 20*b*. For instance, handkerchiefs or functional elements for comforting the child's olfactory senses can be held in a receptacle element.

4. A functional mat 1 for assisting deep sleep for an infant based on an embodiment of the present invention can also have an electronic device installed in a specified position thereof. Such an electronic device can include, for instance, a vibration module for simulating a mother's heartbeat, a sound module for outputting a song or voice sounds, and the like.

5. A functional mat 1 based on an embodiment of the present invention can have a handle attached for convenient portability, a mosquito net installed, or various other accessories attached or installed. Also, a functional mat 1 based on an embodiment of the present invention can be used in connection with an external structure such as a bed, crib, support, etc., but the spirit and scope of the present invention are not limited by such functions.

The scope of the present invention is not limited by the disclosure and expressions of the embodiments explicitly described above. It is also to be appreciated that the scope of the present invention cannot be limited by modifications or substitutions that are obvious in the field of art to which the present invention pertains.

What is claimed is:

1. A functional mat for assisting deep sleep for an infant, the functional mat comprising:

a mat body configured to support an object in an upward direction, the object being an infant's body;

a side supporter protruding in a perpendicular direction from a surface of the mat body so as to form an overall shape of a hill, the side supporter configured to support the object in a sideward direction; and a pressure supporter positioned intersecting or crossing across the mat body along a widthwise direction, the pressure supporter secured to the mat and configured to be placed in close contact with the object, wherein a center portion of the side supporter protrudes towards a middle of the mat body further than end portions of the side supporter in a parallel direction to the surface of the mat body, wherein a cushion filling part configured to face the object is installed on the pressure supporter.

2. The functional mat for assisting deep sleep for an infant according to claim 1, wherein the side supporter is installed such that it is detachable with respect to the mat body.

3. The functional mat for assisting deep sleep for an infant according to claim 1, wherein the pressure supporter is installed such that it is detachable with respect to the mat.

4. The functional mat for assisting deep sleep for an infant according to claim 1, wherein the cushion filling part is installed inside of an outer lining of the pressure supporter so as to adjust a position of cushion filler within the cushion filling part.

5. The functional mat for assisting deep sleep for an infant according to claim 1, wherein a securing means for securing the pressure supporter is installed at a mat edge position or a lower surface position of the side supporter.

6. The functional mat for assisting deep sleep for an infant according to claim 1, wherein one or more fastening holes are installed in the side supporter.

7. The functional mat for assisting deep sleep for an infant according to claim 6, wherein the one or more fastening holes is a hole penetrating through a mat edge side and a lower surface of the side supporter, and wherein a fastener installed on the mat body is inserted into the hole to fasten the mat body and the side supporter.

8. The functional mat for assisting deep sleep for an infant according to claim 7, wherein a connector piece on one side of the pressure supporter is coupled with the fastener to secure the one side of the pressure supporter.

9. The functional mat for assisting deep sleep for an infant according to claim 6, wherein the one or more fastening holes are a hole penetrating through a mat edge side and an opposite side of the side supporter, and wherein a connector piece on one side of the pressure supporter is inserted into the hole and connected to the mat body to secure the one side of the pressure supporter.

10. The functional mat for assisting deep sleep for an infant according to claim 1, wherein one side of the pressure supporter is configured to be positioned over the object and the other side is configured to be positioned under the object with respect to the object during use of the pressure supporter.

11. The functional mat for assisting deep sleep for an infant according to claim 1, wherein the pressure supporter includes a pair of wings, and wherein the pair of wings are configured to be fastened to each other over the object and configured to be placed in close contact with the object during use of the pressure supporter.

12. The functional mat for assisting deep sleep for an infant according to claim 1, wherein the side supporter is installed on the mat body and corresponds to any one of:

a side supporter installed at one side of the mat body;

side supporters installed at both sides of the mat body;

a side supporter installed near a center of the mat body; and side supporters installed at an upper side, a lower side, a left side, and a right side of the mat body.

13. The functional mat for assisting deep sleep for an infant according to claim 1, wherein an edge at an opposite end of the mat body from a position where the side supporter is installed has a greater height than that of a surface at a center portion of the mat body.

* * * * *